US009140258B2

(12) United States Patent
Fissler et al.

(10) Patent No.: US 9,140,258 B2
(45) Date of Patent: Sep. 22, 2015

(54) GEAR MACHINE HAVING A NON-CIRCULAR LOW-PRESSURE CONNECTION

(71) Applicant: Robert Bosch GmbH, Stuttgart (DE)

(72) Inventors: Volker Fissler, Tamm (DE); Michael Wilhelm, Vaihingen/Enz (DE); Christian Boehmcker, Schwieberdingen (DE); Michael Fischer, Muehlacker (DE)

(73) Assignee: Robert Bosch GmbH, Stuttgart (DE)

( * ) Notice: Subject to any disclaimer, the term of this patent is extended or adjusted under 35 U.S.C. 154(b) by 58 days.

(21) Appl. No.: 14/030,109

(22) Filed: Sep. 18, 2013

(65) Prior Publication Data

US 2014/0086779 A1 Mar. 27, 2014

(30) Foreign Application Priority Data

Sep. 24, 2012 (DE) ..... 10 2012 217 115

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/08*** | (2006.01) |
| ***F04C 2/18*** | (2006.01) |
| ***F04C 15/06*** | (2006.01) |

(52) U.S. Cl.

CPC . *F04C 2/088* (2013.01); *F04C 2/18* (2013.01); *F04C 15/06* (2013.01); *F04C 2250/101* (2013.01)

(58) Field of Classification Search

USPC ..... 418/131–132, 206.1–206.9

See application file for complete search history.

(56) References Cited

U.S. PATENT DOCUMENTS

| | | | | |
|---|---|---|---|---|
| 4,090,820 | A * | 5/1978 | Teruyama | 418/132 |
| 4,097,206 | A * | 6/1978 | Schonherr | 418/206.4 |
| 4,334,840 | A * | 6/1982 | Teruyama | 418/206.4 |
| 5,190,450 | A * | 3/1993 | Ghosh et al. | 418/189 |
| 6,312,241 | B1 * | 11/2001 | Kamamoto et al. | 418/206.4 |
| 2012/0114514 | A1 * | 5/2012 | Laetzel et al. | 418/206.7 |

FOREIGN PATENT DOCUMENTS

DE 10 2009 012 853 A1 9/2010

* cited by examiner

*Primary Examiner* — Theresa Trieu

(74) *Attorney, Agent, or Firm* — Maginot, Moore & Beck LLP

(57) ABSTRACT

A gear machine includes two externally intermeshing gear wheels enclosed by a housing that has a high-pressure connection and a low-pressure connection situated opposite one another. On an inner circumferential face of the housing, a notional boundary line is assigned to both gear wheels. The line runs parallel to the line of contact between the gear tooth tips of the gear wheels and the inner circumferential face. The intersection edge is located between the two boundary lines and the minimum distance between the intersection edge and the boundary lines are at least one pitch interval of the gear wheels. The cross sectional shape of the low-pressure connection deviates from the circular shape such that its cross sectional area overlapping the gear wheels is greater than the cross sectional area of a notional, circular low-pressure connection overlapping the gear wheels at the same minimum distance from the boundary lines.

14 Claims, 5 Drawing Sheets

GEAR MACHINE HAVING A NON-CIRCULAR LOW-PRESSURE CONNECTION

This application claims priority under 35 U.S.C. §119 to patent application no. DE 10 2012 217 115.0, filed on Sep. 24, 2012 in Germany, the disclosure of which is incorporated herein by reference in its entirety.

BACKGROUND

The disclosure relates to a gear machine having the features of the disclosure.

DE 10 2009 012 853 A1 discloses a gear machine which can be operated as a pump or as a motor. The gear machine comprises two externally intermeshing gear wheels, which are enclosed by a housing. The housing comprises a high-pressure connection and a low-pressure connection situated opposite one another.

When the gear machine is operated as a pump, one of the gear wheels is set in rotational motion, for example by an electric motor, pressure fluid, in particular hydraulic oil, flowing from the low-pressure connection to the high-pressure connection. When the gear machine is operated as a motor, the pressure fluid flows from the high-pressure connection to the low-pressure connection, thereby setting the gear wheels in rotational motion.

In the direction of a central axis the low-pressure connection has a constant cross sectional shape, which is of circular design. The aim is to make the corresponding circle diameter as large as possible at the low-pressure connection, in order that low rates of flow of the pressure fluid occur at this connection. This serves to prevent cavitation on the low-pressure connection, particularly in the case of pumps with rapidly rotating gear wheels.

Here the scope for increasing the diameter of the low-pressure connection is limited by the need to maintain an adequate seal between the high-pressure connection and the low-pressure connection at the gear tooth tips of the gear wheels.

Attention must be drawn in this context to the pressure equalization chamfer on the bearing liners. The bearing liners are arranged on both sides next to the gear wheels and are pressed tightly against the lateral faces of the gear wheels by the pressure fluid. Here the gear wheels are supported by circular cylindrical bearing journals in the bearing liners. The bearing liner on one side of the gear wheels may be formed in one piece, but it is equally feasible to assign a separate part of the bearing liner to each gear wheel.

At least one pressure equalization chamfer on the bearing liners, which is arranged opposite the lateral faces of the gear wheels and the inner circumferential face, is assigned to each gear wheel. Here the inner circumferential face is the face against which the gear tooth tips of the gear wheels tightly bear. The pressure equalization chamfer extends from the high-pressure connection in the direction of the low-pressure connection. The pressure at the high-pressure connection therefore prevails in all tooth spaces of the gear wheels which are situated opposite the pressure equalization chamfer, so that in the area of the low-pressure connection the gear wheels are pressed tightly against the inner circumferential face of the housing with an accurately predictable force, in order to bring about sealing there.

In dimensioning the diameter of the low-pressure connection, it must be ensured that in no rotational position of the gear wheels does a fluid exchange connection exist between the pressure equalization chamfer and the low-pressure connection by way of the tooth spaces.

The object of the disclosure is to prevent cavitation at the low-pressure connection in rapidly rotating gear machines, especially pumps, or to allow this to occur only at higher rotational speeds of the gear wheels.

SUMMARY

According to the disclosure, this object is achieved in that on the inner circumferential face of the housing a notional boundary line, which intersects the end of the pressure equalization chamfer, is assigned to both gear wheels, said line running parallel to the line of contact between the gear tooth tips of the gear wheels and the inner circumferential face, the intersection edge being located between the two boundary lines, the minimum distance between the intersection edge and the boundary lines being at least one pitch interval of the gear wheels, the cross sectional shape of the low-pressure connection deviating from the circular shape in such a way that its cross sectional area overlapping the gear wheels is greater than the cross sectional area of a notional, circular low-pressure connection overlapping the gear wheels at the same minimum distance from the boundary lines. Where two pressure equalization chamfers are assigned to a gear wheel, these are preferably designed so that they define the same boundary line. If, exceptionally, this is not the case, the boundary line at the shortest distance from the low-pressure connection is the prevailing line.

The proposed gear machine comprises a low-pressure connection which has a larger cross sectional area than the prior art. This serves to reduce the rates of flow at the low-pressure connection, so that cavitation occurs only at higher rotational speeds of the gear wheels.

It should be noted that said minimum distance is measured along the inner circumferential face of the housing, that is to say in a circumferential direction relative to the axis of rotation of the gear wheel in question. The same applies to the pitch interval of the gear wheels, that is say the distance between two gear tooth tips.

Advantageous developments and enhancements of the disclosure are specified in the dependent claims.

The cross sectional shape of the low-pressure connection can be designed so that the intersection edge is at a constant distance from the associated boundary line.

This results in a low-pressure connection which has the largest possible cross sectional area.

The cross sectional shape of the low-pressure connection may comprise two first straight lines, which each run substantially parallel to an associated boundary line. The first straight lines are significantly easier to produce than the ideal cross sectional shape described above. Where helically toothed gear wheels are used, the intersection edge between the inner circumferential face and the low-pressure connection no longer runs quite precisely parallel to the boundary lines. The deviation is so slight, however, that there is no risk of any significant impairment with regard to the occurrence of cavitation. If straight-toothed gear wheels are used, the ideal state proposed above is realized.

The two first straight lines may be connected by at least one, preferably two, second straight lines, which run in alignment with the lateral faces of the gear wheels. This results in the largest possible cross sectional area of the low-pressure connection.

The two first straight lines may be connected to one another by at least one, preferably two, circular arcs. This cross sectional shape is preferably used when a standardized flange, which is intended for a circular passage for the pressure fluid, is provided at the low-pressure connection, externally on the housing. Here the greater of said circular arcs is preferably formed in alignment with the standardized circular passage, in particular having the same radius.

The cross sectional shape of the low-pressure connection may have rounded corners, making it easy to manufacture using a shank-type milling cutter. The radius of the corners here corresponds to the radius of the shank-type milling cutter.

The cross sectional shape of the low-pressure connection may be formed by more than one, preferably two or three, overlapping circles, which have centers offset in relation to one another. This is intended to further facilitate manufacture compared to the cross sectional shapes described above. Here the intention, in particular, is to produce said circles through separate boring operations, the axis of rotation of the relevant boring bits being arranged offset in relation to one another. With the preferred two or three bores it is already possible to achieve a significant improvement in respect of the tendency to cavitation.

The low-pressure connection may overlap at least one bearing liner. The working of the gear machine is not adversely affected if the low-pressure connection overlaps the bearing liners. Although this is not capable of achieving any direct improvement in the cavitation behavior, it is nevertheless easier to harmonize the cross sectional shape of the low-pressure connection optimally with the boundary lines in the area of the gear wheels.

BRIEF DESCRIPTION OF THE DRAWINGS

The disclosure is explained in more detail below with reference to the drawings attached, of which.

DETAILED DESCRIPTION

Figure 1:
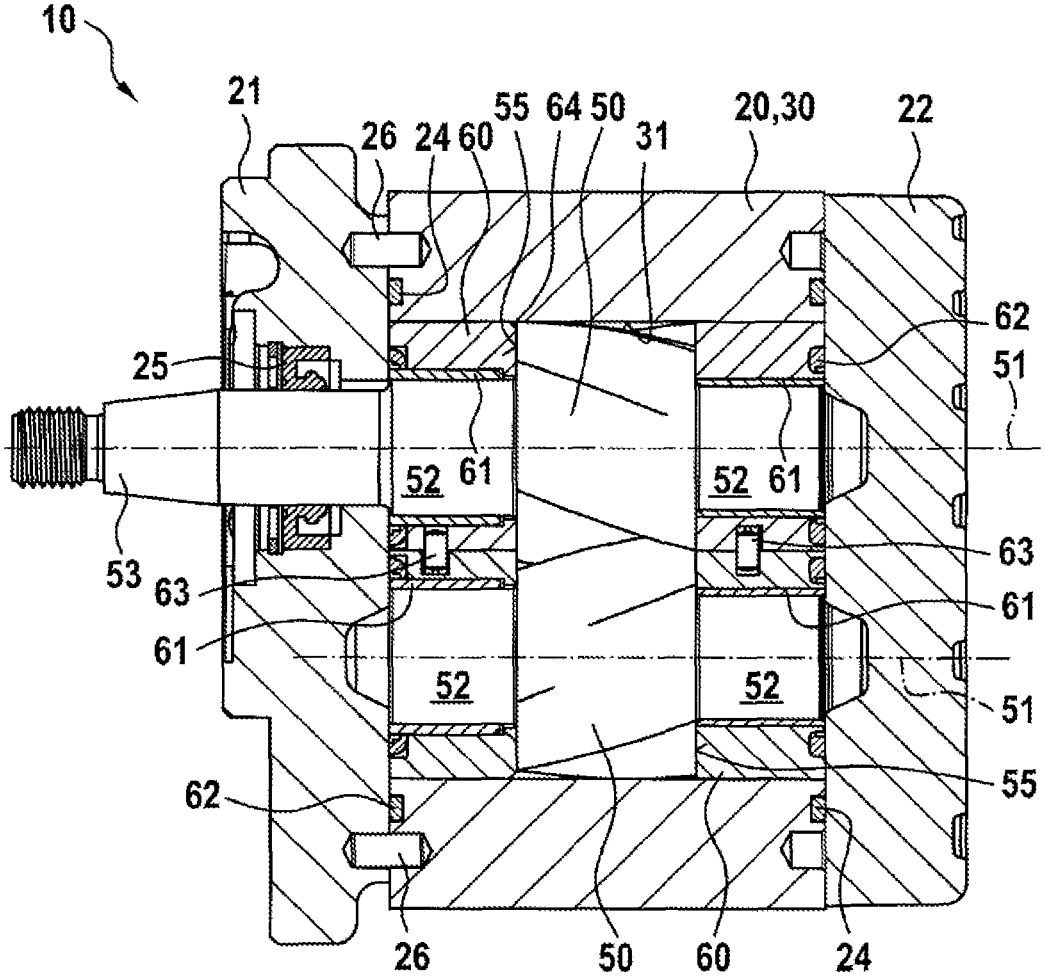
FIG. 1 represents a longitudinal section of a gear machine according to the disclosure.

FIG. 1 shows a longitudinal section of a gear machine 10 according to the disclosure. The gear machine 10 comprises a housing 20, which is assembled from a main body 30, a drive cover 21 and an end cover 22, which are preferably composed of aluminum or grey cast iron. The driver cover 21 and the end cover 22 bear on plane end faces at the opposite ends of the main body 30, O-rings 24 composed of an elastomer being provided on the end faces, in order that no pressure fluid can escape from the corresponding joint. The drive cover 21 and the end cover 22 are aligned relative to the main body 30 by means of cylindrical pins 26 and are firmly bolted to these by means of bolts (not shown).

Two gear wheels 50 are accommodated in the housing 20 so that they can rotate about an associated axis of rotation 51, the gear wheels 50 meshing externally with one another. Said axes of rotation 51 run parallel to one another. The gear wheels 50 here are helically toothed but they may also be of straight-toothed design. It should be noted here that the problem of cavitation addressed by the disclosure occurs primarily with helically toothed gear wheels.

The two gear wheels 50 have a circular cylindrical bearing journal 52 on both sides, which is rotatably supported in a bearing shell 61 composed of a plain bearing material such as brass or bronze, the bearing shell 61 in turn being firmly accommodated in an associated bearing liner 60 made of steel. In the present embodiment a separate part of the bearing liner 60 is assigned to each bearing journal 52, two adjacent parts bearing on one another at plane faces and being aligned relative to one another by means of a cylindrical pin 26. The bearing liners 60 may also be formed in one piece. In the gear machine 10 the bearing liners 60 are pressed against the plane lateral faces 55 of the gear wheels 50 by the pressure of the pressure fluid, for example hydraulic oil, in order to bring about lateral sealing of the gear wheels 50. The pressure fluid here acts on the bearing liner 60 in a pressure field which is defined by an associated axial seal 62.

One of the bearing journals 52 of a gear wheel 50 is formed in one piece with a drive journal 53, which protrudes from the housing 20 through the drive cover 21. The corresponding passage is tightly closed by a radial shaft seal ring 25, so that no pressure fluid can escape. The drive journal 53 may be rotationally fixed, for example, to the drive shaft of an electric motor (not shown), if the gear machine 10 is operated as a pump.

Ahead of the inlet process along the axes of rotation 51 the inner circumferential face 31 of the main body 30 has a constant cross sectional shape, which is matched with very little play to the circular cylindrical gear tooth tip diameter of the gear wheels 50.

Attention should furthermore be drawn to the pressure equalization chamfer 64 on the left-hand bearing liner 60 in FIG. 1. The pressure equalization chamfer 64 is located opposite the lateral face 55 of an associated gear wheel 50 and opposite the inner circumferential face 31 of the housing 20.

Figure 2:
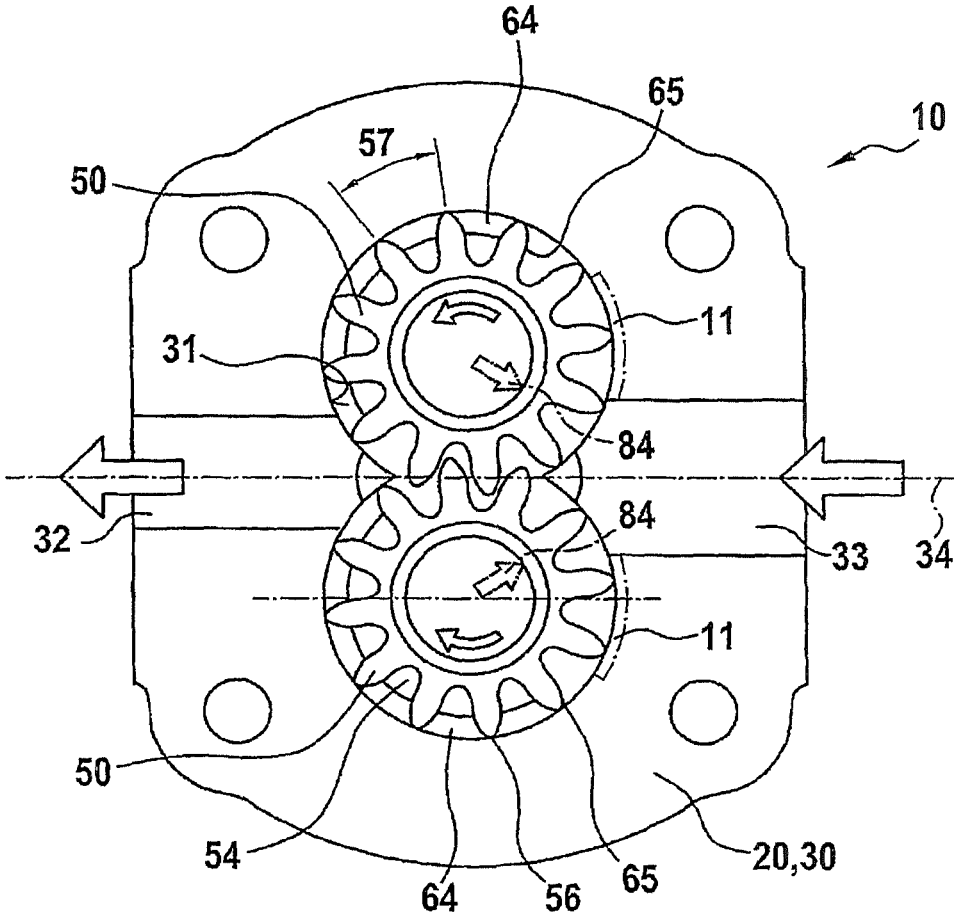
FIG. 2 represents a cross section of a gear machine according to the disclosure.

FIG. 2 shows a cross section of a gear machine 10 according to the disclosure. The high-pressure connection 32 and the low-pressure connection 33 are arranged opposite one another on the housing 20, the connections having a common central axis 34, along which they have a constant cross sectional shape. The high-pressure connection 32 preferably has a circular cross sectional shape, the cross sectional shape of the low-pressure connection 33 according to the disclosure deviating from the circular shape.

The pressure equalization chamfer 64 already referred to extends from the high-pressure connection 32 in the direction of the low-pressure connection 33. It has an end 65, which is located at a distance from the low-pressure connection 33. A pressure which is equal to the pressure at the high-pressure connection 32 therefore prevails everywhere in the tooth spaces 54 which are located in the area of the pressure equalization chamfer 64. In the remaining tooth spaces a lower pressure prevails, which as a result means that a hydraulic force 84 acts on the gear wheels 50, which in a sealing area 11 on the low-pressure connection 33 presses their gear tooth tips 56 against the inner circumferential face 31 of the housing 20. Only there does a sealing contact against the housing 20 occur at the gear tooth tips 56. The remaining gear tooth tips 56 run at a slight distance from the inner circumferential face 31 of the housing 20, so that there pressure fluid can be exchanged between the tooth spaces 54.

The pressure equalization chamfer 64 may be present only on one side of the gear wheels 50, as represented here, but may also be provided on both sides of the gear wheels 50. In the latter case, with helically toothed gear wheels 50, it must be remembered that the two pressure equalization chamfers 64 need to be of different lengths, in order that they terminate at the same tooth of the associated gear wheel 50.

Figure 3:
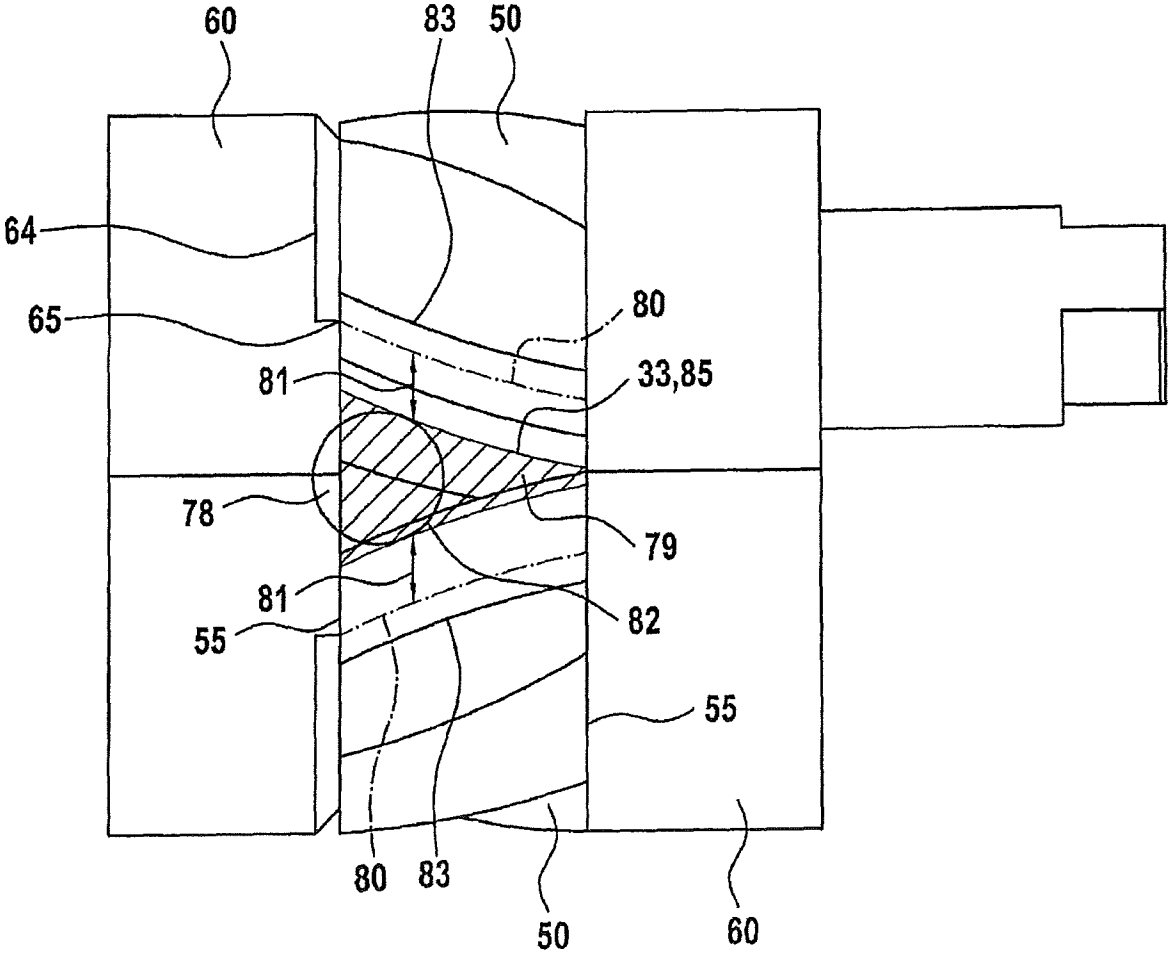
FIG. 3 represents a rough schematic front view of the gear wheels and the bearing liners, showing the ideal shape of the low-pressure connection.

FIG. 3 shows a rough schematic front view of the gear wheels 50 and the bearing liners 60, showing the ideal shape of the low-pressure connection 33. The viewing direction here is parallel to the central axis of the low-pressure connection 33, so that its cross sectional shape with intersection edge 85 coincides with the inner circumferential face of the housing.

The two notional boundary lines 80 run parallel to the helical lines of contact 83 between the gear tooth tips of the gear wheels 50 and the inner circumferential face of the housing. The boundary lines 80 therefore run on the inner circumferential face of the housing. The boundary lines 80 each commence at the end 65 of an associated pressure equalization chamfer 64 on the bearing liner 60.

In the area of the boundary lines 80 the cross sectional shape of the low-pressure connection 33 runs parallel to these. The minimum distance 81 from the boundary lines 80 is therefore the same throughout, resulting in a maximum cross sectional area of the low-pressure connection 33 overlapping the gear wheels. This cross sectional area is drawn in with hatched lines in FIG. 3 and indentified by the reference numeral 79.

As for the rest, the cross sectional shape of the low-pressure connection 33 runs in alignment with the lateral faces 55 of the gear wheels 50. In the case of gear wheels 50 with a very large helix angle it may happen that the low-pressure connection 33 no longer overlaps the right-hand lateral face 55 of the gear wheels 50 in FIG. 3.

Also drawn in FIG. 3 is a notional low-pressure connection 82, which is at the same minimum distance 81 from the boundary lines 80. The corresponding circle 82 overlaps the bearing linings 60, the corresponding area 78 not forming part of the cross sectional area 79 overlapping the gear wheels 50. As can easily be seen, the proportion of the hatched area 79 covered by the circle 82 is significantly smaller than the hatched area 79 proper, so that the condition according to the disclosure is fulfilled.

The minimum distance 81 between the low-pressure connection 33 and the boundary line 80 is at least one pitch interval (No. 57 in FIG. 2) of the gear wheels, the distance chosen preferably being somewhat greater, in order that at least one gear tooth tip bears fully on the inner circumferential face of the housing, irrespective of the rotational position of the gear wheels. By increasing the minimum distance to somewhat more than two or three pitch intervals, it is possible to improve the internal sealing of the gear machine.

Figure 4:
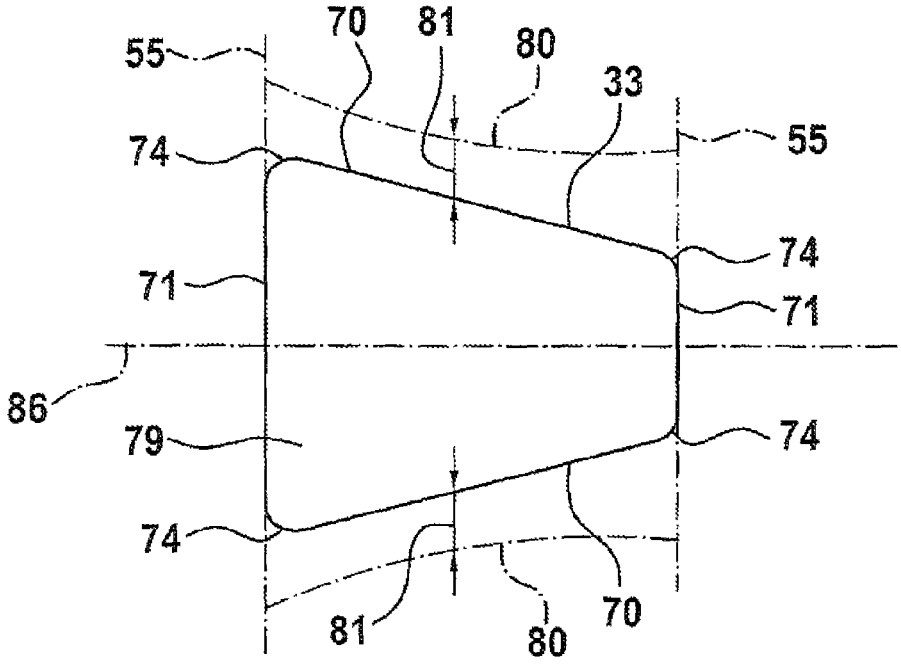
FIG. 4 represents a front view of the low-pressure connection according to a first embodiment of the disclosure.

FIG. 4 shows a front view of the low-pressure connection 33 according to a first embodiment of the disclosure. The viewing direction here is parallel to the central axis of the low-pressure connection 33. The two boundary lines 80 and the two lateral faces 55 of the gear wheels are represented by dash-dot lines.

The cross sectional shape of the low-pressure connection 33 comprises two first straight lines 70, which run substantially parallel to the associated boundary line 80. The two first straight lines 70 are connected by two second straight lines 71, which are arranged in alignment with the lateral faces 55 of the gear wheels. If the gear wheels have a large width and/or a very large helix angle, it may happen that the two first straight lines 70 intersect in the area of the gear wheels. In this case, the right-hand straight line 71 in FIG. 4 is absent.

The corners between the first straight lines 70 and the second straight lines 71 are rounded 74, so that the existing low-pressure connection can be easily produced using a shank-type milling cutter. The corner radius 74 is 5 mm or 7.5 mm, for example. It is also possible, however, to dispense with the rounding 74.

The low-pressure connection 33 according to the first embodiment in FIG. 4 overlaps the gear wheels with its total cross sectional area 79. The corresponding cross sectional shape is mirror-symmetrical about a plane of symmetry 86, which contains the central axis of the low-pressure connection 33.

Figure 5:
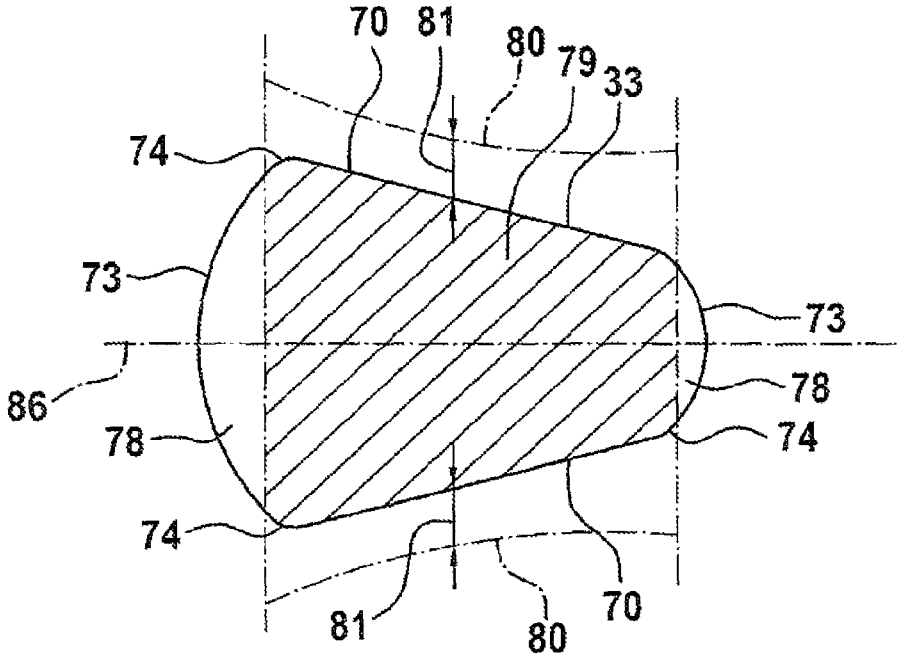
FIG. 5 represents a front view of the low-pressure connection according to a second embodiment of the disclosure.

FIG. 5 shows a front view of the low-pressure connection 33 according to a second embodiment of the disclosure. Except for the differences described below, this embodiment corresponds to the first embodiment according to FIG. 4, so that reference is made to the corresponding explanations. The viewing direction in FIG. 5 corresponds to that in FIG. 4.

The second straight lines have been replaced by circular arcs 73, which are curved outwards. The radius of the left-hand circular arc 73 in FIG. 5 here corresponds to the radius of the passage, which comprises a standardized flange with a circular passage. The overall width of the low-pressure connection 33 is preferably equal to or less than twice said radius.

With the areas 78 the present low-pressure connection 33 also overlaps the bearing liners of the gear machine. The cross sectional area of the low-pressure connection 33 overlapping the gear wheels is the area 79 drawn in with hatched lines in FIG. 5.

Figure 6:
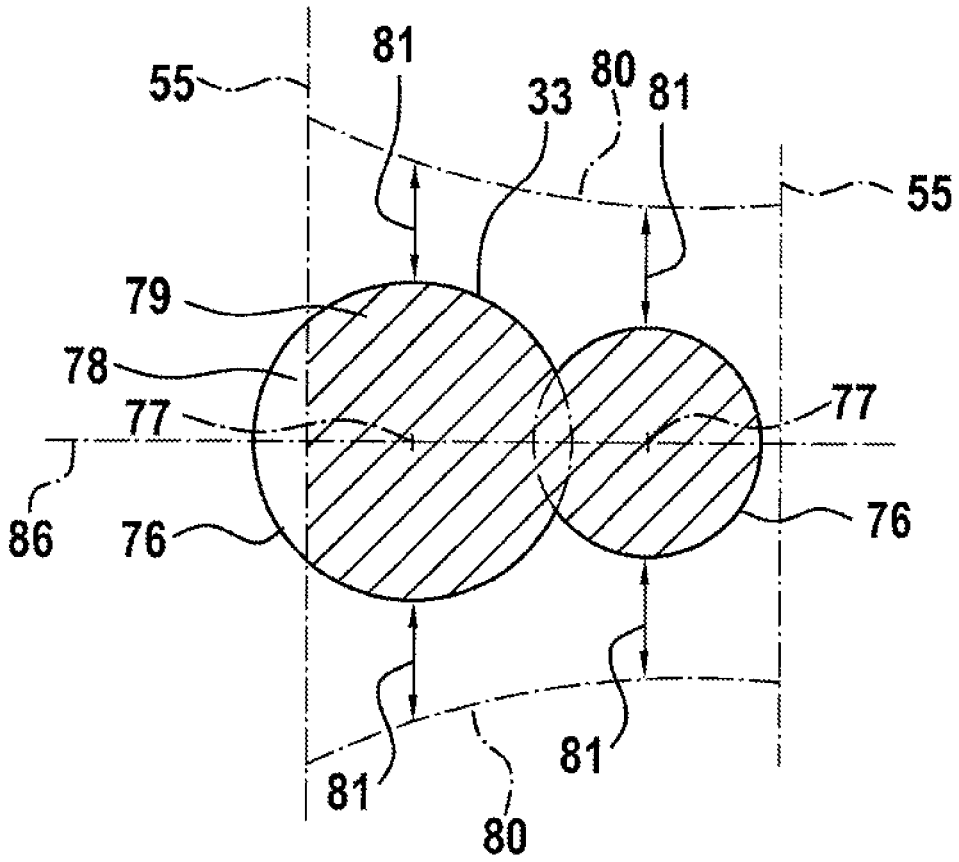
FIG. 6 represents a front view of the low-pressure connection according to a third embodiment of the disclosure.

FIG. 6 shows a front view of the low-pressure connection 33 according to a third embodiment of the disclosure. The viewing direction corresponds to that in FIGS. 4 and 5.

This low-pressure connection 33 is formed by two circular bores 76, which overlap one another. The corresponding cross sectional shape is therefore composed of two circles 76, which overlap one another, these circles having offset centers 77. The centers 77 are arranged on the plane of symmetry 86 of the low-pressure connection 33. Instead of the two circles 76 shown, three or more circles 76 may also be provided, two or three circles producing the optimum compromise between manufacturing costs and the cross sectional area 79 of the low-pressure connection 33 overlapping the gear wheels.

With the area 78 the left-hand circle 76 in FIG. 6 again overlaps a bearing liner, so that the cross sectional area of the low-pressure connection 33 overlapping the gear wheels is the hatched area identified by the numeral 79.

LIST OF REFERENCE NUMERALS

10 gear machine
11 sealing area
20 housing
21 drive cover
22 end cover
24 O-ring
25 radial shaft seal ring
26 cylindrical pin
30 main body
31 inner circumferential face
32 high-pressure connection
33 low-pressure connection
34 central axis of the high and low-pressure connection
50 gear wheel
51 axis of rotation of the gear wheel
52 bearing journal
53 drive journal
54 tooth space
55 lateral face
56 gear tooth tip
57 pitch interval

60 bearing liner
61 bearing shell
62 axial seal
63 cylindrical pin
64 pressure equalization chamfer
65 end of the pressure equalization chamfer
70 first straight line
71 second straight line
73 circular arc
74 rounded corner
76 circle
77 center of the circle
78 area which overlaps the bearing liner
79 cross sectional area overlapping the gear wheels
80 boundary line
81 minimum distance from the boundary line
82 circle with same minimum distance from the boundary line
83 line of contact between gear tooth tip and inner circumferential face of the housing
84 hydraulic force
85 intersection edge
86 plane of symmetry

What is claimed is:

1. A gear machine, comprising:

a housing having a high-pressure connection, a low-pressure connection, a central axis extending through the high-pressure connection and the low-pressure connection, and an inner circumferential face, the low-pressure connection having a constant cross sectional shape in a direction of the central axis, an intersection edge formed where the low-pressure connection intersects the inner circumferential face;

two externally intermeshing gear wheels each including gear tooth tips and at least one lateral face, the gear wheels arranged within the housing such that the inner circumferential face bears tightly against the gear tooth tips, the gear wheels arranged such that the high-pressure connection and the low-pressure connection are situated on opposite sides of the gear wheels; and at least one bearing liner arranged on both sides of each of the gear wheels so as to bear tightly on the at least one lateral faces of the gear wheels, the at least one bearing liner configured to rotatably support each of the gear wheels, the at least one bearing liner having at least one pressure equalization chamfer assigned to each of the gear wheels, the at least one pressure equalization chamfer having an end, the at least one pressure equalization chamfer extending opposite the at least one lateral face of a respective gear wheel and opposite the inner circumferential face, the at least one pressure equalization chamfer extending in a direction from the high-pressure connection toward the low-pressure connection to the end of the at least one pressure equalization chamfer, wherein:

a notional boundary line is assigned to each of the gear wheels, each notional boundary line defined on the inner circumferential face so as to intersect with the end of the at least one pressure equalization chamfer, a line of contact is assigned to each of the gear wheels, each line of contact defined where the gear tooth tips of the respective gear wheel contact the inner circumferential face, each notional boundary line is parallel to the line of contact of the respective gear wheel, the intersection edge is located between the notional boundary lines, a minimum distance between the intersection edge of the low-pressure connection and each of the notional boundary lines is equal to or greater than at least one pitch interval of the gear wheels, the cross sectional shape of the low-pressure connection defines a cross sectional area where the cross sectional shape overlaps with the gear wheels in the direction of the central axis, a notional low-pressure connection has a circular cross sectional shape defined at the minimum distances from the notional boundary lines, the circular cross sectional shape defines a notional cross sectional area where the circular cross sectional shape overlaps with the gear wheels in the direction of the central axis, and the cross sectional shape of the low-pressure connection differs from the circular cross sectional shape such that the cross sectional area is greater than the notional cross sectional area.

2. The gear machine according to claim 1, wherein the cross sectional shape of the low-pressure connection is formed so that the intersection edge is at a constant distance from each of the notional boundary lines.

3. The gear machine according to claim 1, wherein the cross sectional shape of the low-pressure connection comprises two first straight lines, each of the first straight lines arranged nearly parallel to an associated notional boundary line.

4. The gear machine according to claim 3, wherein the two first straight lines are connected by at least one second straight line, the at least one second straight line runs in alignment with the at least one lateral faces of the gear wheels.

5. The gear machine according to claim 4, wherein the two first straight lines are connected by two second straight lines, the second straight lines run in alignment with the lateral faces of the gear wheels.

6. The gear machine according to claim 3, wherein the two first straight lines are connected to one another by at least one circular arc.

7. The gear machine according to claim 6, wherein the two first straight lines are connected to one another by two circular arcs.

8. The gear machine according to claim 1, wherein the cross sectional shape of the low-pressure connection has rounded corners.

9. The gear machine according to claim 1, wherein the cross sectional shape of the low-pressure connection is formed by more than one circle, the circles having centers offset in relation to one another.

10. The gear machine according to claim 9, wherein the cross sectional shape of the low pressure connection is formed by two overlapping circles, which have centers offset in relation to one another.

11. The gear machine according to claim 1, wherein the low-pressure connection overlaps the at least one bearing liner.

12. The gear machine according to claim 1, wherein the gear machine is configured as a pump or a motor.

13. The gear machine according to claim 1, wherein the two externally intermeshing gear wheels are helical toothed gear wheels.

14. The gear machine according to claim 1, wherein:

the inner circumferential face bears tightly against the gear tooth tips along a portion of the inner circumferential face; and the intersection edge intersects with the portion of the inner circumferential face.

* * * * *